US009009870B1

(12) United States Patent
Connick, Jr.

(10) Patent No.: US 9,009,870 B1
(45) Date of Patent: Apr. 21, 2015

(54) GARMENT POCKET FOR RAPID EXTRACTION AND DEPLOYMENT OF A CONCEALED WEAPON

(71) Applicant: William Joseph Connick, Jr., Metairie, LA (US)

(72) Inventor: William Joseph Connick, Jr., Metairie, LA (US)

( * ) Notice: Subject to any disclaimer, the term of this patent is extended or adjusted under 35 U.S.C. 154(b) by 61 days.

(21) Appl. No.: 13/861,112

(22) Filed: Apr. 11, 2013

Related U.S. Application Data

(60) Provisional application No. 61/689,339, filed on Jun. 4, 2012.

(51) Int. Cl.
*A41D 27/20* (2006.01)

(52) U.S. Cl.
CPC ..... *A41D 27/20* (2013.01)

(58) Field of Classification Search
USPC ..... 2/247, 248, 250, 251, 252
See application file for complete search history.

(56) References Cited

U.S. PATENT DOCUMENTS

| | | | | |
|---|---|---|---|---|
| 5,692,237 | A | 12/1997 | Bennett | |
| 6,131,198 | A | 10/2000 | Westrick | |
| 6,760,922 | B1 | 7/2004 | Morales | |
| 6,986,164 | B1 | 1/2006 | Morales | |
| 7,631,368 | B1 | 12/2009 | Samson | |
| 7,743,430 | B2 | 6/2010 | Jennings et al. | |
| 8,307,465 | B2 | 11/2012 | French et al. | |
| 2003/0182714 | A1* | 10/2003 | Mariland et al. | 2/247 |
| 2009/0025117 | A1 | 1/2009 | French | |

* cited by examiner

*Primary Examiner* — Amy Vanatta
*Assistant Examiner* — Sally Haden

(57) ABSTRACT

A novel garment pocket, and method for making said pocket, for the rapid extraction and deployment of a weapon concealed therein. One or more edges of the pocket are reversibly attached to the garment proper by means of quick release, easily disengaged, readily releasable, or break away fasteners. Said edge or edges being located and positioned to permit said weapon to be extracted from said pocket by means of a substantially forward thrust of the hand grasping the weapon through said edge or edges attached by said fasteners. Said hand being the one on the arm that is on the same side of the body as said garment pocket. The pocket of the present embodiments enables the weapon to be extracted from the pocket with a reduced chance of snagging and danger to the garment wearer.

15 Claims, 4 Drawing Sheets

GARMENT POCKET FOR RAPID EXTRACTION AND DEPLOYMENT OF A CONCEALED WEAPON

CROSS REFERENCE TO RELATED APPLICATIONS

Figure 1:
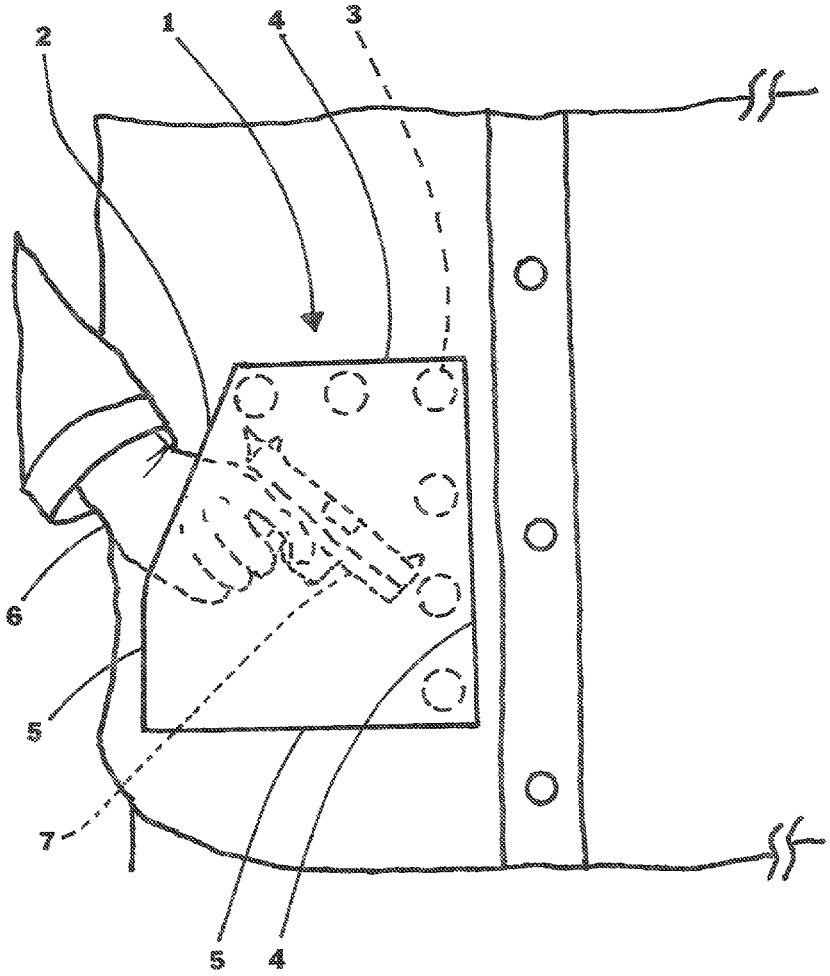

This application claims the benefits of U.S. Provisional Patent Application No. 61/689,339 filed Jun. 4, 2012 by the present inventor, which is incorporated by reference.

FEDERALLY SPONSORED RESEARCH

None

SEQUENCE LISTING

None

BACKGROUND

1. Prior Art

The following is a tabulation of some prior art that presently appears relevant:

| Pat. No. | Kind Code | Issue Date | Patentee |
|---|---|---|---|
| U.S. patents | | | |
| 8,307,465 | B2 | Nov. 13, 2012 | French et al. |
| 7,743,430 | B2 | Jun. 29, 2010 | Jennings et al. |
| 7,631,368 | B1 | Dec. 15, 2009 | Samson |
| 6,986,164 | B1 | Jan. 17, 2006 | Morales |
| 6,760,922 | B1 | Jul. 13, 2004 | Morales |
| 6,131,198 | — | Oct. 17, 2000 | Westrick |
| 5,692,237 | — | Dec. 2, 1997 | Bennett |
| U.S. patent application Publications | | | |
| 20090025117 | A1 | Jan. 29, 2009 | French |

2. Field of the Invention

This invention relates to the field of concealed carry of a weapon and, more specifically, to a garment pocket for the rapid extraction and deployment from the pocket of a weapon concealed therein.

BACKGROUND OF THE INVENTION

People are afraid of being victims of a violent confrontation such as an armed robbery, assault, or rape while out in public. A majority of states in the U.S. now issue concealed handgun permits to those who pass the legal requirements. As a result, many permit holders legally carry a concealed handgun, or other lethal or non-lethal weapons when away from their homes. Some of these individuals work, live, or shop in areas where violent crime is prevalent. They live in fear of being accosted and harmed while walking to their home, vehicle, or to public transportation, especially at night. Others whose jobs involve making deliveries also feel vulnerable and afraid. As a result, there is a growing market for garments that facilitate the concealed carry of a weapon.

An assailant will often seek to benefit from the element of surprise and move quickly to a position that is close in front of an intended victim. Under these conditions, the victim must quickly, almost instantaneously, mount an effective defense to avoid being harmed. If the intended victim is carrying a concealed weapon, such as a handgun, in a normal or traditional garment pocket, the handgun must first be grasped by the hand, then pulled or drawn rearward to extract it from the pocket and, finally, deployed using a forward motion into a firing position aimed toward the assailant. The drawing motion employed is substantially a rearward one, away from the location of the assailant, and one which delays an effective deployment toward the assailant. The physical movements of the body, arm, and hand that are necessary to accomplish this draw will clearly telegraph, that is to make apparent, to an assailant that a weapon is being drawn. This realization may hasten a violent attack upon the victim which will make an effective self-defense less likely to happen.

I have found that the total time required for one of ordinary skill in this type of self-defense to carry out the several motions described above is relatively long. This is particularly so in the event of a sudden and frightening encounter. It is very likely that the handgun being drawn from a normal or unmodified garment pocket using a substantially rearward motion will snag on the fabric of the pocket during the draw. Most models of handguns have exposed hammers, protruding sights, sharp elements, and a bulky grip, any and all of which are prone to snagging on the inside of the pocket which will delay or prevent the extraction and deployment of the weapon. Firing the handgun while it is still confined in the pocket has serious disadvantages such as a very restricted ability to aim. Also, the handgun, especially if it is a semi-automatic pistol, is likely to jam or malfunction when attempting to fire, or after firing, the first shot. This can happen because an exposed hammer can snag on the pocket when the trigger is pulled which prevents the handgun from firing, or the cycling of the pistol slide upon firing can cause it to snag on the pocket fabric, or the spent cartridge case will not fully be ejected from the pistol, thereby preventing the firing of a second shot. Similarly, a revolver may have its hammer or its cylinder snag, preventing a first or second shot from being fired. The rapid and reliable extraction and deployment of a concealed handgun from a pocket can be crucial to a successful defense, especially if multiple assailants are present.

If a civilian is wearing a vest or garment of a type that is usually used by law enforcement, security, or military personnel, or that is otherwise constructed in a manner that makes it obvious to an assailant that a weapon is probably carried therein, the element of surprise in deploying the weapon is lost. Accordingly, there is a need for garments of ordinary or "normal style," but with a pocket or pockets that are constructed so as to permit the rapid, effective extraction and deployment of a handgun, or other weapon concealed therein, for self-defense.

Several types of garment pockets made with releasable fasteners for carrying concealed handguns have been proposed. French (U.S. Patent Application 20090025117) discloses a pocket for carrying in a concealed and readily-accessible state, a handgun or other object. The pocket is configured and disposed to restrict lateral movement of the handgun in the part of the pocket where the handgun is stored. The pocket of French is secured, in part, by "readily-releasable" fasteners to facilitate withdrawing a handgun. These fasteners are located on the top of the pocket, they are not placed on the front or forward edge, that is, the edge closest to the center of the garment. The fasteners of French are located to optimize a conventional rearward draw of the handgun from the pocket by enlarging the pocket opening. The pocket taught by French does not permit a forward thrust of the handgun from the pocket through the forward edge. In fact, the forward portion of the pocket is securely affixed to the garment, contrary to the teaching of an embodiment of the present invention. The same disadvantage applies to the teaching of French et al. (U.S. Pat. No. 8,307,465).

Westrick (U.S. Pat. No. 6,131,198) pertains to a "tactical vest carrier" that holds ballistic body armor and has a pocket that additionally contains a handgun holster. The vest is easily recognized as belonging to a specific type and style used primarily by law enforcement personnel, not civilians. Jennings et al. (U.S. Pat. No. 7,743,430) pertains to a gun concealment garment, such as a vest, that has a "concealing pocket," within which is a concealed holster pocket. Bennett (U.S. Pat. No. 5,692,237) teaches a device for carrying a concealed weapon comprising fabric panels with a holster secured to one of the panels. The panels, and the handgun carried in the holster inside the panels, are located on the inside of the garment. Samson (U.S. Pat. No. 7,631,368) pertains to undergarments with holsters for concealment and carry of weapons that are accessed from outer clothing.

Morales 2004 (U.S. Pat. No. 6,760,922) concerns a particular tactical vest design, particularly for police use. The vest has a hidden pocket located on the inside of the vest, which contains a gun holster which can be oriented in various positions. The pocket may be closed with patches of Velcro along the edge of the opening slot. The front of the garment must be unfastened to permit access by the hand reaching for a handgun concealed in the pocket. Morales 2006 (U.S. Pat. No. 6,986,164) pertains to a tactical shirt with a hidden front pocket for carrying a concealed weapon. The pocket is deep and allows a weapon to be inserted into the region below the armpit.

The garment pockets of Westrick, Jennings et al., Bennett, Samson, Morales (2004), and Morales (2006) all require a "cross draw" method of retrieving a handgun concealed in the pockets. A cross draw is one whereby the handgun must first be pulled or drawn by the hand on the arm opposite to the side of the garment onto which the pocket is affixed. In other words, a right handed person keeps the handgun in a left garment pocket, and a left handed person keeps it in a right pocket. To retrieve or extract the handgun from the pocket, the arm and hand across the body from the pocket must cross over the center of the body, disengage fasteners, enter the pocket, disengage holster snaps (Westrick, Jennings, et al., Bennett, Samson, Morales 2004, and Morales 2006), grasp the handgun, and withdraw it using an across-the-body and rearward motions. Only after these several motions and manipulations have been carried out can the handgun be deployed forward in a normal defensive posture. An additional hazard inherent in a cross draw, or in a conventional rearward draw, is that parts of the body can be in the line of fire of the handgun as it is being drawn and deployed and injury can result in the event of a premature discharge.

A further disadvantage of a cross draw occurs when the handgun is grasped and held in a pocket on the opposite side of the body while going about normal activities, because this posture does not look natural. In fact, this posture would telegraph to an assailant that a weapon is being grasped. Another limitation to the pockets of Westrick, Jennings et al., Bennett, Samson, Morales (2004), and Morales (2006) is that they are unsuitable for use as pant pockets because of their cross draw teaching. Pant pockets are usually positioned too low on the body to make a cross draw practical. An additional disadvantage inherent in the pockets of Westrick, Jennings et al., Bennett, Samson, Morales (2004), and Morales (2006) is that they are not designed for, nor functional for, the user of the pocket to insert a hand to warm it because the edges or seams that must be open to permit normal access of a hand have been sewn closed.

Furthermore, the pockets of Bennett and Morales (2004) are affixed on the inside of the garment and, therefore, the front of the garment must be sufficiently unfastened to allow access to the pocket and the weapon concealed therein. This type of construction further complicates and slows down drawing and deploying a weapon. Similar disadvantages apply to the undergarment holster of Samson.

I have discovered that prior art teachings regarding retrieval, pulling, extracting, or drawing of a handgun or other weapon concealed in a garment pocket require multi-step motions which are relatively slow to accomplish in a circumstance where speed is essential for defense. The motions are likely to lead to snagging of the weapon in the pocket as well as raise safety concerns. In some prior art teachings heretofore discussed, when the weapon is a handgun, it must additionally be drawn from a holster within the pocket, a procedure requiring additional steps to unfasten snaps that are securing the handgun in the holster. Also, the body motions clearly telegraph to an assailant that the intended victim is reaching for a weapon, and this realization may lead to a sudden attack. Additionally, these body motions may be hindered when the garment wearer is seated and there is a back to the seat. The prior art, then, does not teach a successful solution to a need to rapidly extract and deploy a concealed weapon from a garment pocket. In fact, the prior art cited teaches away from the present embodiments.

It will be apparent from the following that the present embodiments are novel and overcome the disadvantages and impediments inherent in the prior art by teaching an improved garment pocket, a method for making the pocket, and a garment with the pocket.

Advantages of the Present Invention

I have found that several advantages of one or more aspects of the present embodiments substantially and unexpectedly overcome the shortcomings of the prior art by teaching a garment pocket and method for making the pocket, said pocket being particularly suitable for the fast, effective, one-handed, extraction and deployment of a weapon or other object weapon concealed in the pocket. In the case where the weapon is a handgun, it can be pushed or thrust through the quick release, easily disengaged, readily releasable, or break away fasteners that are securing or closing the front or forward edge of the pocket, in a natural, rapid, and instinctive forward and outward motion with a reduced chance of snagging. The substantially forward extraction and deployment of a handgun from the pocket reduces exposure of the wearer's body to injury in the event of a premature discharge.

As heretofore stated, the front or forward edge of the pocket is meant to describe the edge nearest the center front of the garment. If the top edge of the pocket is not open to access by the hand by its design, that edge as well as the front edge are reversibly closed or secured with the fasteners which detach when the hand and handgun are pushed or thrust against them. The pocket or pockets of these embodiments can be made part of garments of normal or traditional types or styles that are commonly worn for everyday activities, as well as be made a part of tactical style garments. Existing garments may be retrofitted with the pocket or pockets of these embodiments such as by a tailor or seamstress or one skilled in those crafts. Furthermore, the hand may be inserted in the pocket to grasp and hold onto the handgun in the normal course of activities such as walking or sitting without telegraphing that a weapon is in the pocket. I have found that an already grasped handgun can be extracted from the pocket and deployed, that is, put into a defensive or ready-to-fire position or posture, with economy of motion, enhanced speed, and improved safety.

Other advantages of one or more aspects or embodiments will be apparent from a consideration of the drawings and ensuing descriptions.

SUMMARY OF THE INVENTION

It is an object of the present embodiments to provide a garment pocket that permits the rapid extraction and deployment of a handgun or any other lethal or non-lethal weapon such as a knife, tear gas or pepper spray dispenser, stun gun, electroshock weapon, a weapon that incapacitates by causing pain, or similar objects that are useful for self-defense purposes with a reduced chance of snagging within the pocket and with improved safety. The pocket is constructed so that a substantial portion of the front edge, or, in some cases, the front and upper edges, of the pocket are secured to the garment by means of quick release, easily disengaged, readily releasable, or break away fasteners such as hook-and-loop (as those sold under the trade name "Velcro"), snaps, magnets, adhesives, or other devices in this category or with these properties. The edge or edges closed by the fasteners depend upon the type of pocket and the position or location of the edge or portion of the pocket that is left open to allow normal access by the hand. The pocket size, material, and construction are optimized to adequately contain and secure the weapon and the hand that will grasp it. The number, positioning, and type of the fasteners are optimized to adequately contain a handgun or other weapon in the pocket during normal activities, yet disengage, detach, or open when thrust upon in a substantially forward motion with a reasonable, practical, and effective amount of force.

A lower portion or section of the forward edge of the pocket to which the readily releasable fasteners are affixed may be stitched closed below the fasteners to better secure and contain a concealed weapon from inadvertently falling through the fasteners as long the stitched section does not impede the substantially forward, or forward and upward, extraction and deployment of the weapon taught by the present embodiments.

Additional holding devices such as straps, fasteners, or lining materials may be incorporated in the pocket to secure, contain, or position handguns, particularly if the handguns are large or heavy or if a high degree of physical activity is anticipated. These devices are within the scope of the present embodiments as long as they do not substantially impede the rapid extraction and deployment of a concealed handgun from the pocket.

The garment pocket of these embodiments is located on the same side of the wearer's body as the arm and hand that are intended to grasp, extract, and deploy the weapon inside it. The pocket's design allows the uncomplicated, fast, and instinctive extraction and forward deployment of the weapon with reduced chance of snagging and, when the weapon is a handgun, to a reduced exposure of the wearer's body to injury from a premature discharge. The appearance and function of the pocket are like that of common garment pockets but with the additional properties imparted by the present embodiments.

One of ordinary skill in the art, such as a civilian with little or no training in self-defense, will particularly benefit from the garment pocket of these embodiments. However, the inherent advantages of the pocket will apply to garments for law enforcement, security, and military personnel as well.

The garments of the present embodiments are, but are not limited to, coats, parkas, jackets, vests, sweatshirts, or pants that are typically worn as outerwear. It may be desirable to have more than one of the pockets incorporated into the garment. For the purpose of subsequent description and illustration, a handgun is selected from the group of weapons that is suitable for concealment on an individual.

Upon being pushed or thrust substantially forward, or forward and upward, or outward with sufficient force, the handgun, and the hand grasping it, opens, disengages, detatches, or releases the fasteners on the selected edge or edges of the pocket allowing the handgun to exit or be extracted from the pocket, be rapidly deployed, and fired. Because no substantial rearward motion is necessary to extract the handgun, there is a reduced chance that it will become snagged in the pocket during this procedure. The entire sequence or motions can proceed with an economy of motion, speed, and with a natural and instinctive motion of the arm and hand holding the handgun toward an assailant.

It will be apparent from the figures that the hand can grasp the handgun concealed within the pocket in a manner that is normal in appearance for an extended period of time. This feature is beneficial because an assailant is not likely to be alerted that a handgun can quickly be deployed by the intended victim.

It is an additional embodiment to provide a method for making the garment pocket for the rapid extraction and deployment of a concealed handgun with a reduced chance of snagging the handgun inside the pocket heretofore described, and with enhanced safety. A further embodiment is to provide a garment with the pocket for the rapid extraction and deployment of a concealed handgun with a reduced chance of snagging the handgun inside the pocket heretofore described, and with enhanced safety. The pocket of the present embodiments is located on, and affixed to, the same side of the garment as the hand that will extract and deploy it.

DRAWINGS

Figures

FIG. 1 shows a garment pocket of one type of common construction which is open on a rearward diagonal portion or edge to admit the hand on that side of the body in the normal use of the pocket. The pocket is fitted with the fasteners heretofore described that are affixed to the upper and front edges to reversibly close the pocket edges. The garment wearer's right hand is inside the right pocket of the garment and is grasping a weapon, in this instance a handgun, that is concealed in the pocket.

Figure 2:
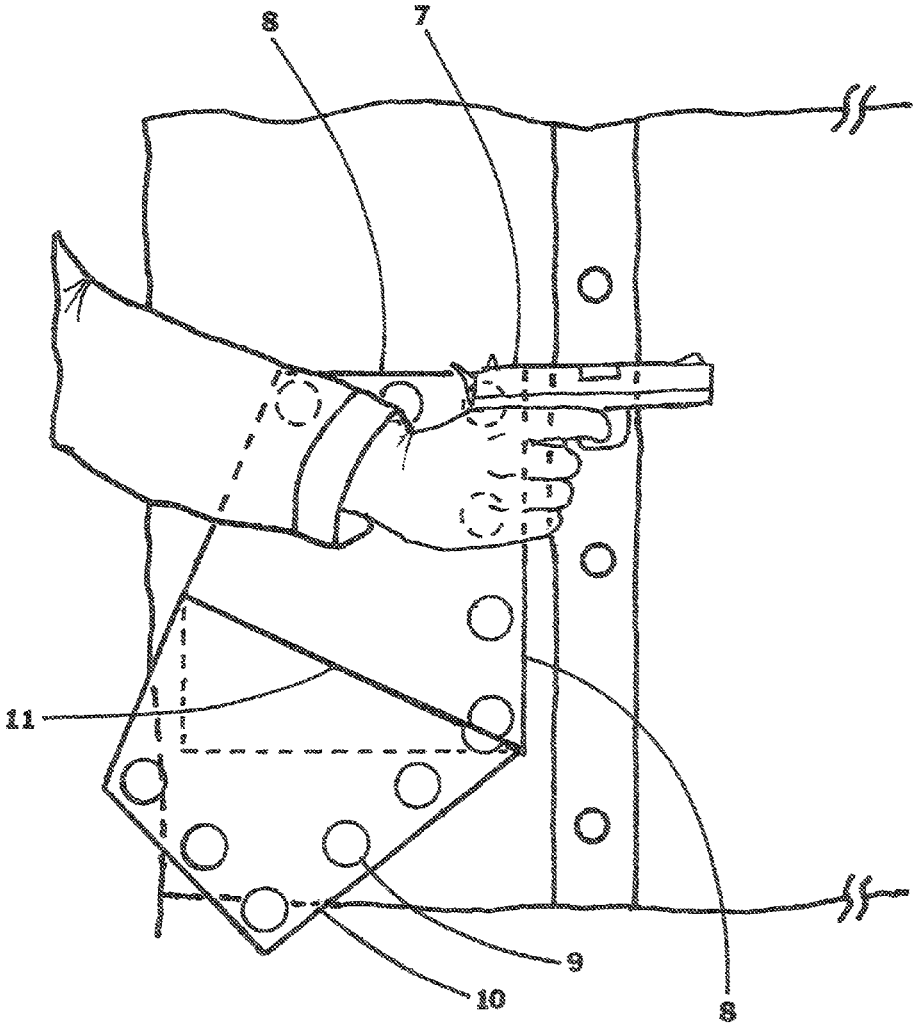

FIG. 2 shows the hand and handgun of FIG. 1 after being pushed or thrust by a substantially forward, or forward and upward, motion through the pocket edges previously held closed by the fasteners of FIG. 1, and deployed in a defensive manner. The resulting pocket flap has been moved down and away as a result of these actions.

Figure 3:
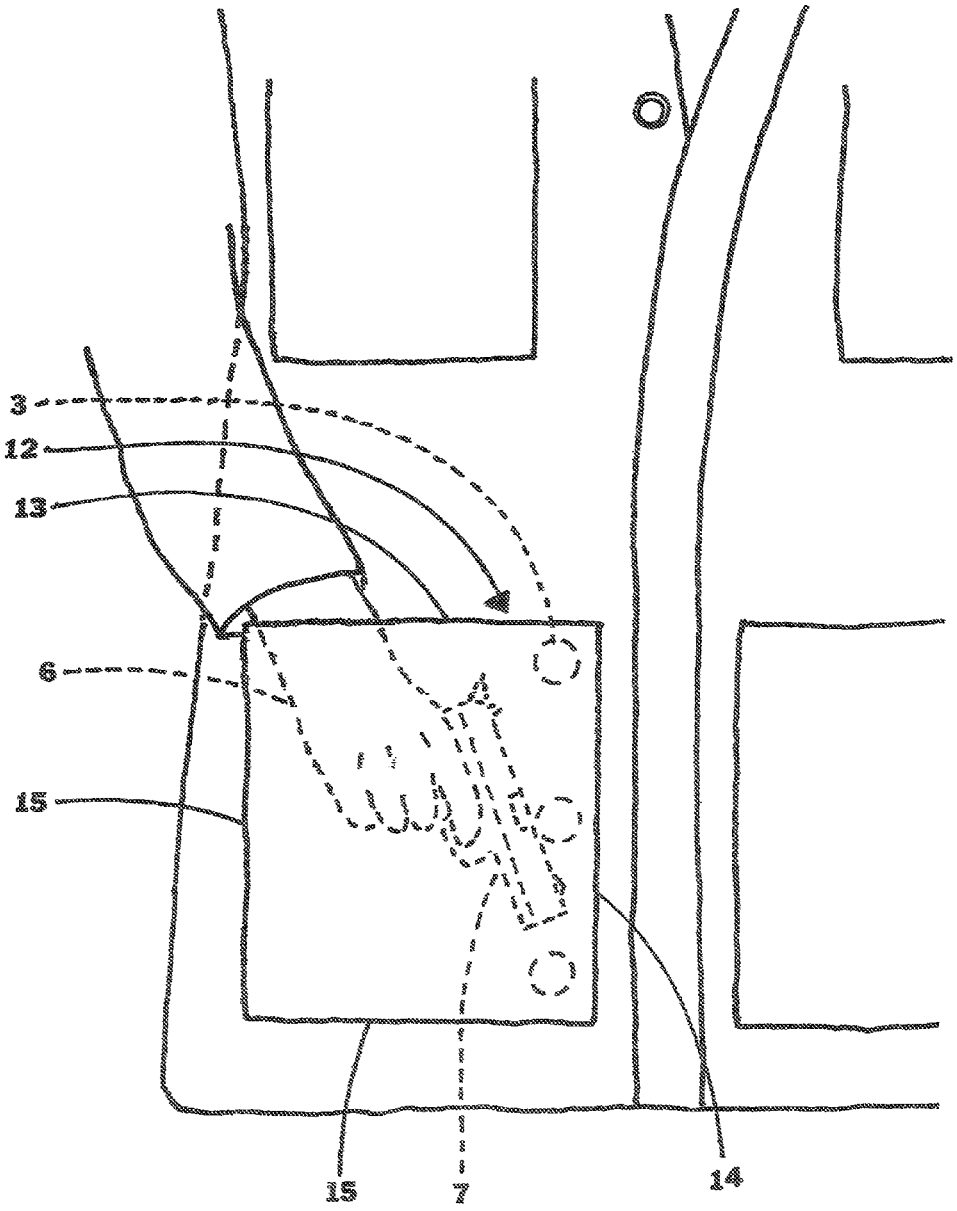

FIG. 3 shows a garment pocket of a different type of construction than the pocket of FIG. 1. The pocket of FIG. 3 is sometimes referred to as a patch or flap-covered pocket. In this construction, the top of the pocket is already open by design to allow the normal access by the hand on that side of the body. The quick release, easily disengaged, readily releasable, or break away fasteners already described are affixed to, and reversibly close, the forward edge of the pocket. The garment wearer's right hand is depicted holding a weapon, in this instance a handgun, that is concealed in the right pocket of the garment.

Figure 4:
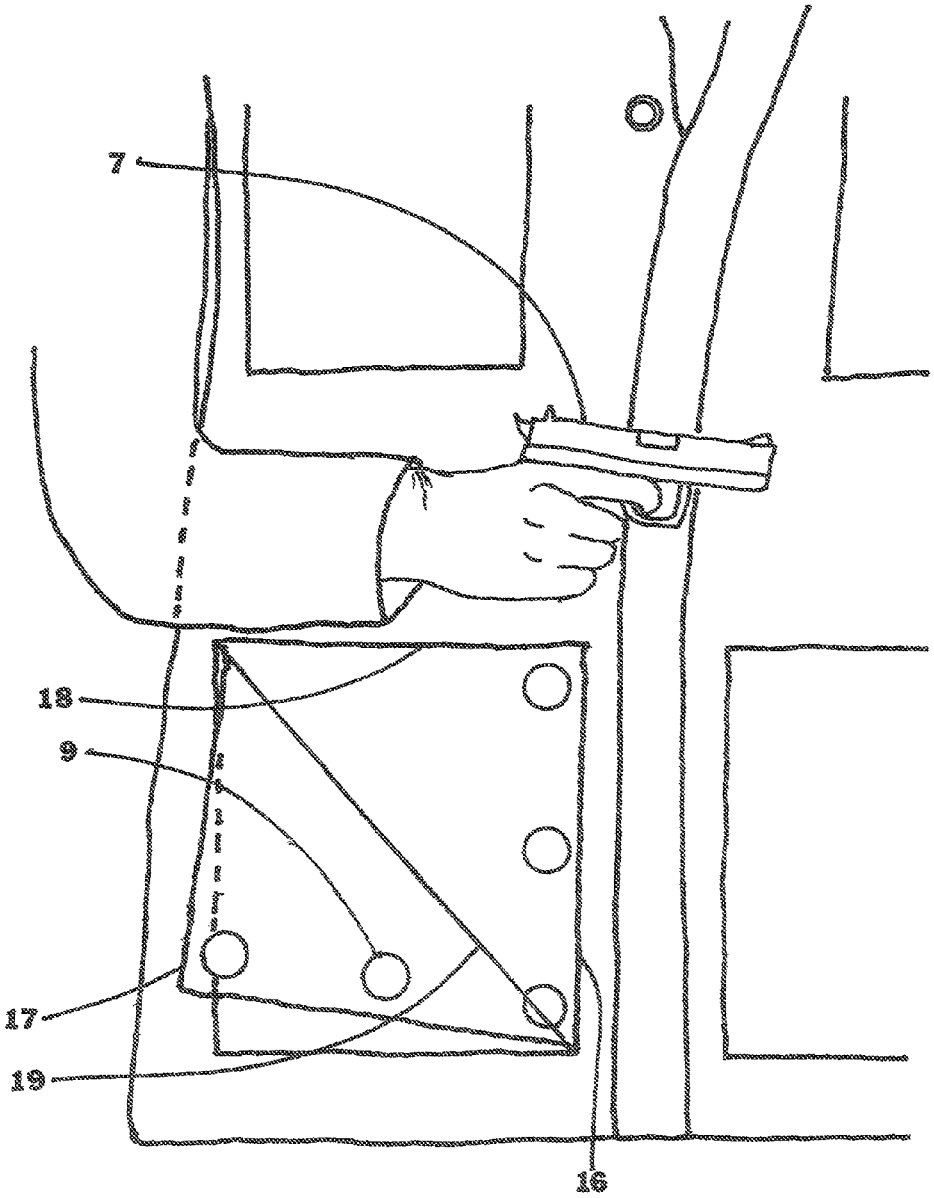

FIG. 4 shows the pocket of FIG. 3 after the handgun has been pushed or thrust substantially forward, or forward and upward, causing the fasteners to open, or disengage, or release and the pocket flap thus formed has been moved out of the way of the handgun. The handgun is shown in an extracted and deployed state.

DETAILED DESCRIPTION OF FIGURES AND EMBODIMENTS

FIG. 1 shows a frontal view of a garment constructed with a pocket 1 in accordance with an embodiment of the present invention. The pocket illustrated is of a type that has a beveled or diagonal portion or edge 2 that is intentionally left open to allow normal access by the hand on the same side of the garment wearer's body as the pocket. Quick release, easily disengaged, readily releasable, or break away fasteners 3, such as those of the hook-and-loop type, snaps, magnets, adhesives, or others of that class of fasteners that can unfasten, open, disengage, detatch, break open, or release when pushed or thrust upon, are affixed on the top and forward edges 4 of the pocket to reversibly close the edges. The fasteners can be in the form of several individual units as depicted or as strips. Pocket edges 5 are securely attached to the garment such as by stitching. FIG. 1 depicts the right hand 6 of the garment wearer inside the right hand pocket grasping a handgun 7. A left hand and left pocket concept is equally applicable under the teachings of this invention. The pocket is made to a size that is adequate to accommodate the hand and handgun in a concealed manner. The number, type, and placement of the fasteners can be optimized to adequately contain and retain a handgun or other weapon in the pocket during normal activities, yet open, detatch, disengage, or release when thrust upon with reasonable and practical force.

FIG. 2 illustrates the pocket of FIG. 1 after the garment wearer has thrust, pushed, or shoved handgun 7 substantially forward, or forward and upward, and outward of the pocket through the fasteners and reversibly fastened edges of FIG. 1 thereby extracting it from the pocket. The pocket enables the concealed handgun to be extracted and deployed in a forward direction by means of a continuous, natural, instinctive, and rapid motion. The now open edges 8, and the now disengaged fastener halves 9, are illustrated as well as the pocket flap 10 that results after the fasteners are disengaged. Line 11 depicts the upper margin or portion of the newly-formed pocket flap 10.

FIG. 3 shows a frontal view of a garment with pocket 12 of different construction from the pocket of FIG. 1. The pocket of FIG. 3 has the top portion 13 intentionally left open to allow normal access by the hand on the arm on the same side of the garment wearer's body. The fasteners 3, already described for FIG. 1, are attached to, and reversibly close, the forward edge 14 of the pocket. The fasteners can be in the form of several individual units as depicted or as strips. Pocket edges 15 are securely attached to the garment such as by stitching. FIG. 3 depicts the right hand 6 of the garment wearer inside the right hand pocket grasping a handgun 7. A left hand and left pocket concept is equally applicable under the teachings of this invention. The pocket is of a size that is adequate to accommodate the hand and handgun in a concealed manner. The number, type, and placement of the easily detachable and readily releasable fasteners can be optimized to adequately contain and retain a handgun or other weapon in the pocket during normal activities, yet open, detatch, disengage, or release when thrust upon with reasonable and practical force.

FIG. 4 illustrates the pocket of FIG. 3 after the garment wearer has thrust, pushed, or shoved handgun 7 substantially forward, or forward and upward, or outward of the pocket through the fasteners and the reversibly fastened edge of FIG. 3 and clear of the pocket. The pocket design enables the concealed handgun to be extracted and deployed in a forward and outward direction by means of a continuous, natural, instinctive, and rapid motion. The now-open edge 16 and the now disengaged fastener halves 9 are shown as well as the pocket flap 17 that results when the fasteners are disengaged. Line 18 depicts the original top edge of the pocket of FIG. 1 and line 19 depicts the upper portion or margin of the newly-formed pocket flap 17.

Other Potential Embodiments

Other embodiments may include garment pockets for the elderly or infirm whereby pocketed hands can be rapidly thrust out of the pocket to break a fall.

While this invention has been described with reference to the embodiments stated, it will be understood by those skilled in the art that various changes may be made and equivalents substituted for elements thereof without departing from the scope of the invention. In addition, many modifications may be made to adapt a particular situation or material without departing from the essential scope of the present invention. Thus the scope of the embodiments should be determined by the appended claims and their legal equivalents, rather than by the examples given.

I claim:

1. A garment pocket for rapid extraction and deployment of an object from the pocket comprising:

(a) said pocket being on the outside of a garment on either a right side or a left side, or said pocket being on the right side and another said pocket being on the left side, of said garment with a front, back, left and right sides, and an inside and an outside, and said pocket or pockets not substantially crossing a front center line of said garment, (b) said pocket having a top edge, a forward edge which is the edge nearest the center front of the garment, a bottom edge, and a rearward edge, (c) said bottom edge being securely attached to said garment by stitching, (d) said pocket having said top edge or said rearward edge being open and not attached to the garment for a sufficient length adapted to receive a hand of the garment wearer, and the garment wearer may grasp said object in the pocket, (e) when said top edge of said pocket is open, a sufficient length of said forward edge is attached to the garment by means of fasteners, said fasteners being fastened by means of quick release, easily disengaged, readily releasable, or break away fasteners, whereby said object is adapted to be extracted from said pocket by said garment wearer when grasping said object, by means of a substantially forward thrust of said object through said forward edge, (f) when said rearward edge of said pocket is open, said top edge and a sufficient length of said forward edge is attached to the garment by means of said quick release, easily disengaged, readily releasable, or break away fasteners, whereby said object is adapted to be extracted from said pocket by said garment wearer when grasping said object, by means of a substantially forward thrust of said object through said forward edge, (g) when said garment pocket with said object is being worn, said garment pocket is positioned, configured, disposed, substantially oriented, and adapted to facilitate receiving the hand of the garment wearer on the same side of said garment wearer's body as said garment pocket without said hand crossing said center line of said garment.

2. The garment pocket of claim 1 wherein said object is a weapon.

3. The garment pocket of claim 2 wherein said weapon is selected from the group consisting of handguns, knives, tear gas dispensers, pepper spray dispensers, stun guns, and electroshock weapons.

4. The garment pocket of claim 1 wherein said quick release, easily disengaged, readily releasable, or break away fasteners are selected from the group consisting of hook-and-loop, snaps, magnets, and adhesives.

5. The garment pocket of claim 1 wherein said garment is selected from the group consisting of coats, parkas, jackets, vests, and pants.

6. A method of making a garment pocket for rapid extraction and deployment of an object from the pocket, the method comprising:

(a) locating said pocket on the outside of a garment on either a right side or a left side, or said pocket being on the right side and another said pocket being on the left side, of a garment with a front, back, left and right sides, and an inside and an outside, and said pocket or pockets not substantially crossing a front center line of said garment, (b) providing said pocket on the garment with a top edge, a forward edge which is the edge nearest the center front of the garment, a bottom edge, and a rearward edge, (c) providing that said bottom edge is securely attached to said garment by stitching, (d) providing said pocket having said top edge or said rearward edge being open and not attached to the garment for a sufficient length adapted to receive a hand of the garment wearer, and the garment wearer may grasp said object in the pocket, (e) providing that when said top edge of said pocket is open, a sufficient length of said forward edge is attached to the garment by means of fasteners, said fasteners being fastened by means of quick release, easily disengaged, readily releasable, or break away fasteners, whereby said object is adapted to be extracted from said pocket by said garment wearer when grasping said object by means of a substantially forward thrust of said object through said forward edge, (f) providing that when said rearward edge is open, said top edge and a sufficient length of said forward edge is attached to the garment by means of said quick release, easily disengaged, readily releasable, or break away fasteners, whereby said object is adapted to be extracted from said pocket by said garment wearer when grasping said object, by means of a substantially forward thrust of said object through said forward edge, (g) positioning, configuring, disposing, and substantially orienting said garment pocket so that when said garment pocket with said object is being worn, said garment pocket is adapted to receive the hand of the garment wearer on the same side of said garment wearer's body as said garment pocket.

7. The method of claim 6 wherein said object is a weapon.

8. The method of claim 7 wherein said weapon is selected from the group consisting of handguns, knives, tear gas dispensers, pepper spray dispensers, stun guns, and electroshock weapons.

9. The method of claim 6 wherein said quick release, easily disengaged, readily releasable, or break away fasteners are selected from the group consisting of hook-and-loop, snaps, magnets, and adhesives.

10. The method of claim 6 wherein a garment is selected from the group consisting of coats, parkas, jackets, vests, and pants.

11. A garment with a pocket for rapid extraction and deployment of an object from the pocket comprising:

(a) said pocket being on the outside of said garment on either a right side or a left side, or said pocket being on the right side and another said pocket being on the left side, of said garment with a front, back, left and right sides, and an inside and an outside, and said pocket or pockets not substantially crossing a front center line of said garment, (b) said pocket having a top edge, a forward edge which is the edge nearest the center front of the garment, a bottom edge, and a rearward edge, (c) said bottom edge being securely attached to said garment by stitching, (d) said pocket having said top edge or said rearward edge being open and not attached to the garment for a sufficient length adapted to receive a hand of the garment wearer, and the garment wearer may grasp said object in the pocket, (e) when said top edge of said pocket is open, a sufficient length of said forward edge is attached to the garment by means of fasteners, said fasteners being fastened by means of quick release, easily disengaged, readily releasable, or break away fasteners, whereby said object is adapted to be extracted from said pocket by said garment wearer when grasping said object, by means of a substantially forward thrust of said object through said forward edge, (f) when said rearward edge of said pocket is open, said top edge and a sufficient length of said forward edge is attached to the garment by means of said quick release, easily disengaged, readily releasable, or break away fasteners, whereby said object is adapted to be extracted from said pocket by said garment wearer when grasping said object, by means of a substantially forward thrust of said object through said forward edge, (g) when said garment pocket with said object is being worn, said garment pocket is positioned, configured, disposed, substantially oriented, and adapted to facilitate receiving the hand of the garment wearer on the same side of said garment wearer's body as said garment pocket without said hand crossing said center line of said garment.

12. The garment with the pocket of claim 11 whereby the object extracted and deployed is a weapon.

13. The garment of claim 12 whereby the weapon is selected from the group consisting of handguns, knives, tear gas dispensers, pepper spray dispensers, stun guns, and electroshock weapons.

14. The garment of claim 11 wherein said quick release, easily disengaged, readily releasable, or break away fasteners are selected from the group consisting of hook-and-loop, snaps, magnets, and adhesives.

15. The garment of claim 11 wherein the garment is selected from the group consisting of coats, parkas, jackets, vests, and pants.

* * * * *